US009995482B2

(12) United States Patent
Cadima

(10) Patent No.: US 9,995,482 B2
(45) Date of Patent: Jun. 12, 2018

(54) GAS BURNER ASSEMBLY

(71) Applicant: General Electric Company, Schenectady, NY (US)

(72) Inventor: Paul Bryan Cadima, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 299 days.

(21) Appl. No.: 14/940,595

(22) Filed: Nov. 13, 2015

(65) Prior Publication Data

US 2017/0138592 A1 May 18, 2017

(51) Int. Cl.
*F23D 14/04* (2006.01)
*F23D 14/84* (2006.01)
*F23D 14/06* (2006.01)

(52) U.S. Cl.
CPC ..... *F23D 14/84* (2013.01); *F23D 14/045* (2013.01); *F23D 14/06* (2013.01); *F23D 2900/14062* (2013.01)

(58) Field of Classification Search
CPC ..... F23D 14/84
USPC ..... 126/39 H, 39 K, 374.1
See application file for complete search history.

(56) References Cited

U.S. PATENT DOCUMENTS 3,592,180 A * 7/1971 Kweller ..... F23D 14/04 126/214 R
7,967,004 B2 * 6/2011 Inzaghi ..... F23D 14/045 126/214 C
2014/0238384 A1 8/2014 Cadima
2014/0246009 A1 9/2014 Tisselli et al.
2015/0107577 A1 4/2015 Jeong et al.

FOREIGN PATENT DOCUMENTS

CN 103900086 A 7/2014

* cited by examiner

*Primary Examiner* — Avinash Savani
(74) *Attorney, Agent, or Firm* — Dority & Manning, P.A.

(57) ABSTRACT

A gas burner assembly includes a grate that defines a first internal fuel passage and a second internal fuel passage. A burner defines an inner burner ring and an outer burner ring. The first internal fuel passage of the grate extends to the inner burner ring, and the second internal fuel passage of the grate extends to the outer burner ring. A fuel chamber of the inner burner ring is contiguous with the plurality of flame ports of inner burner ring, and a fuel chamber of the outer burner ring is contiguous with the plurality of flame ports of outer burner ring. At least a portion of the fuel chamber of the outer burner ring is positioned directly below the fuel chamber of the inner burner ring.

19 Claims, 5 Drawing Sheets

GAS BURNER ASSEMBLY

FIELD OF THE INVENTION

The present subject matter relates generally to gas burner assemblies, such as gas burner assemblies for cooktop appliances.

BACKGROUND OF THE INVENTION

Generally, gas cooktop appliances include a plurality of gas burners mounted to a top surface of the appliance. During use of the cooktop, spills and overflows can lead to food particles accumulating on the top surface of the cooktop. Such food particles can collect beneath the gas burners and be difficult to clean.

Oven appliance users frequently cite difficulty cleaning beneath the gas burners as a complaint about modern cooktops. However, cleaning below gas burners on modern cooktops is difficult for a variety of reasons. For example, gas burners that are fastened to the cooktops generally include cracks at assembly interfaces that tend to accumulate food particles. As another example, gas burners that are removable from the cooktops by a user of the cooktop for cleaning generally include holes, supporting geometry and fasteners that are difficult to clean around. In addition, gas burners positioned coincident to top surfaces of associated cooktops inherently heat the top surfaces of the cooktops. The hot top surface of the cooktop can burn food particles, and burnt food particles on the cooktop can be particularly difficult to clean.

Accordingly, a cooktop appliance with features for facilitating cleaning below a burner of the cooktop appliance would be useful. In addition, a cooktop appliance with features for limiting heat transfer from a burner of the cooktop appliance to a top panel of the cooktop appliance would be useful.

BRIEF DESCRIPTION OF THE INVENTION

The present subject matter provides a gas burner assembly. The gas burner assembly includes a grate that defines a first internal fuel passage and a second internal fuel passage. A burner defines an inner burner ring and an outer burner ring. The first internal fuel passage of the grate extends to the inner burner ring, and the second internal fuel passage of the grate extends to the outer burner ring. A fuel chamber of the inner burner ring is contiguous with the plurality of flame ports of inner burner ring, and a fuel chamber of the outer burner ring is contiguous with the plurality of flame ports of outer burner ring. At least a portion of the fuel chamber of the outer burner ring is positioned directly below the fuel chamber of the inner burner ring. Additional aspects and advantages of the invention will be set forth in part in the following description, or may be apparent from the description, or may be learned through practice of the invention.

In a first exemplary embodiment, a gas burner assembly is provided. The gas burner assembly includes a grate configured for supporting a cooking utensil. The grate defines a first internal fuel passage and a second internal fuel passage. A burner defines an inner burner ring and an outer burner ring. The inner burner ring and the outer burner ring each define a plurality of flame ports. The first internal fuel passage of the grate extends to the inner burner ring such that fuel is directed to the inner burner ring via the first internal fuel passage of the grate. The second internal fuel passage of the grate extends to the outer burner ring such that fuel is directed to the outer burner ring via the second internal fuel passage of the grate. The inner burner ring and the outer burner ring each define a fuel chamber. The fuel chamber of the inner burner ring is contiguous with the plurality of flame ports of inner burner ring. The fuel chamber of the outer burner ring is contiguous with the plurality of flame ports of outer burner ring. At least a portion of the fuel chamber of the outer burner ring is positioned directly below the fuel chamber of the inner burner ring.

In a second exemplary embodiment, a gas burner assembly is provided. The gas burner assembly includes a grate configured for supporting a cooking utensil. The grate defines a first internal fuel passage and a second internal fuel passage. A burner defines an inner burner ring and an outer burner ring. The inner burner ring and the outer burner ring each defining a plurality of flame ports. The first internal fuel passage of the grate extends to the inner burner ring such that fuel is directed to the inner burner ring via the first internal fuel passage of the grate. The second internal fuel passage of the grate extends to the outer burner ring such that fuel is directed to the outer burner ring via the second internal fuel passage of the grate. The inner burner ring and the outer burner ring each define a fuel chamber. The fuel chamber of the inner burner ring is contiguous with the plurality of flame ports of inner burner ring. The fuel chamber of the outer burner ring is contiguous with the plurality of flame ports of outer burner ring. A bottom wall of the inner burner ring and a bottom wall of the outer burner ring spaced apart from each other at the fuel chamber of the outer burner ring such that the fuel chamber of the outer burner ring is disposed between the bottom wall of the inner burner ring and the bottom wall of the outer burner ring.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
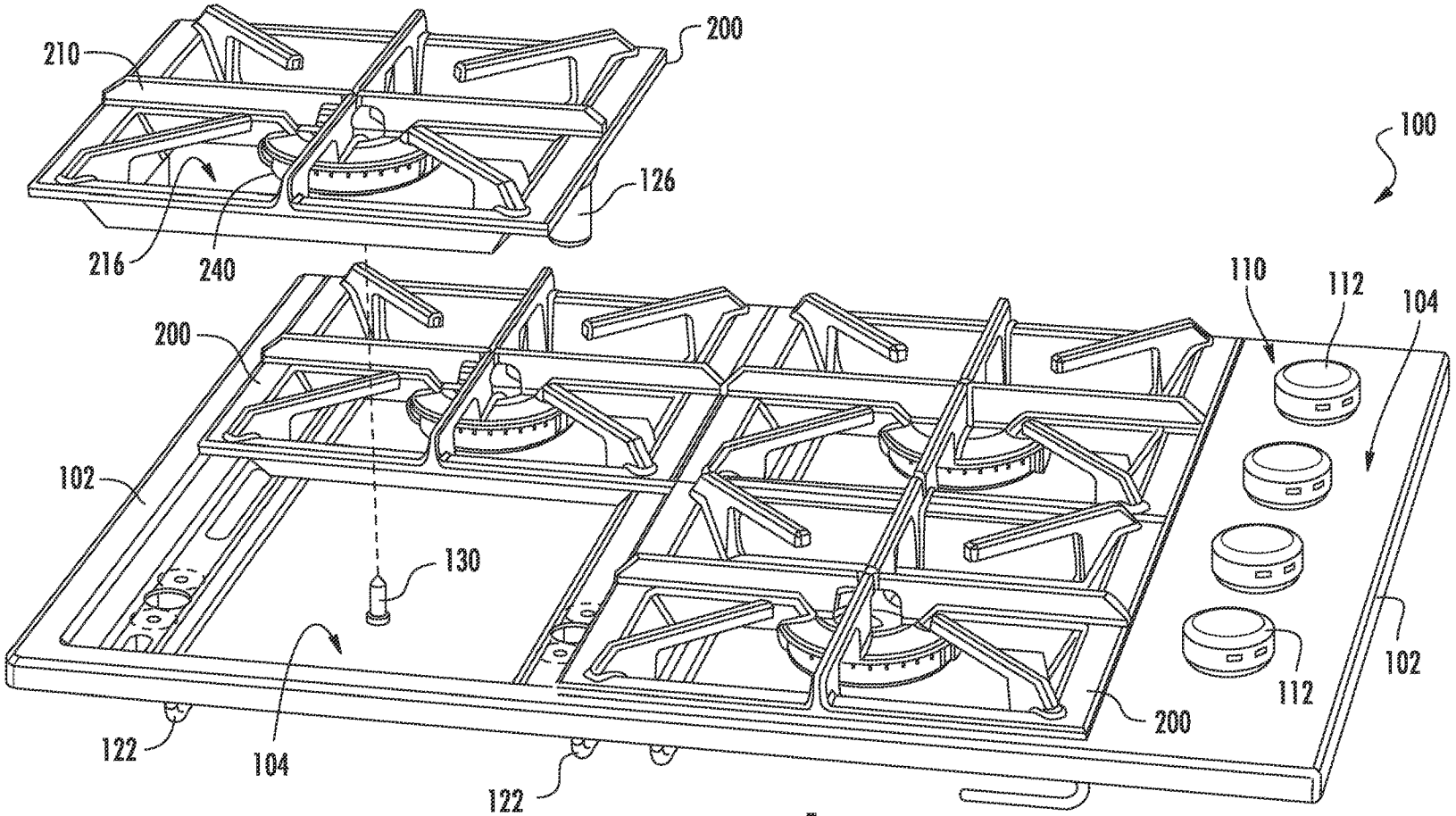
FIG. 1 provides a top, perspective view of a cooktop appliance according to an exemplary embodiment of the present subject matter with a gas burner assembly of the exemplary cooktop appliance shown removed from a panel of the exemplary cooktop appliance.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 illustrates an exemplary embodiment of a cooktop appliance 100 as may be employed with the present subject matter. Cooktop appliance 100 includes a panel 102, e.g., a top panel. By way of example, panel 102 may be constructed of enameled steel, stainless steel, glass, ceramics and combinations thereof.

For cooktop appliance 100, a utensil holding food and/or cooking liquids (e.g., oil, water, etc.) may be placed onto gas burner assemblies 200 at a location of any of gas burner assemblies 200. Gas burner assemblies 200 can be configured in various sizes so as to provide e.g., for the receipt of cooking utensils (i.e., pots, pans, etc.) of various sizes and configurations and to provide different heat inputs for such cooking utensils. Gas burner assemblies 200 are supported on a top surface 104 of panel 102, as discussed in greater detail below. Gas burner assemblies 200 provide thermal energy to cooking utensils above panel 102.

A user interface panel 110 is located within convenient reach of a user of the cooktop appliance 100. For this exemplary embodiment, user interface panel 110 includes knobs 112 that are each associated with one of gas burner assemblies 200. Knobs 112 allow the user to activate each burner assembly and determine the amount of heat input provided by each gas burner assemblies 200 to a cooking utensil located thereon. User interface panel 110 may also be provided with one or more graphical display devices that deliver certain information to the user such as e.g., whether a particular burner assembly is activated and/or the level at which the burner assembly is set.

Although shown with knobs 112, it should be understood that knobs 112 and the configuration of cooktop appliance 100 shown in FIG. 1 is provided by way of example only. More specifically, user interface panel 110 may include various input components, such as one or more of a variety of touch-type controls, electrical, mechanical or electromechanical input devices including rotary dials, push buttons, and touch pads. User interface panel 110 may include other display components, such as a digital or analog display device designed to provide operational feedback to a user.

Cooktop appliance 100 shown in FIG. 1 illustrates an exemplary embodiment of the present subject matter. Thus, although described in the context of cooktop appliance 100, the present subject matter may be used in cooktop appliances having other configurations, e.g., a cooktop appliance with one, two, or more additional burner assemblies. Similarly, the present subject matter may be used in cooktop appliances that include an oven, i.e., range appliances.

Figure 2:
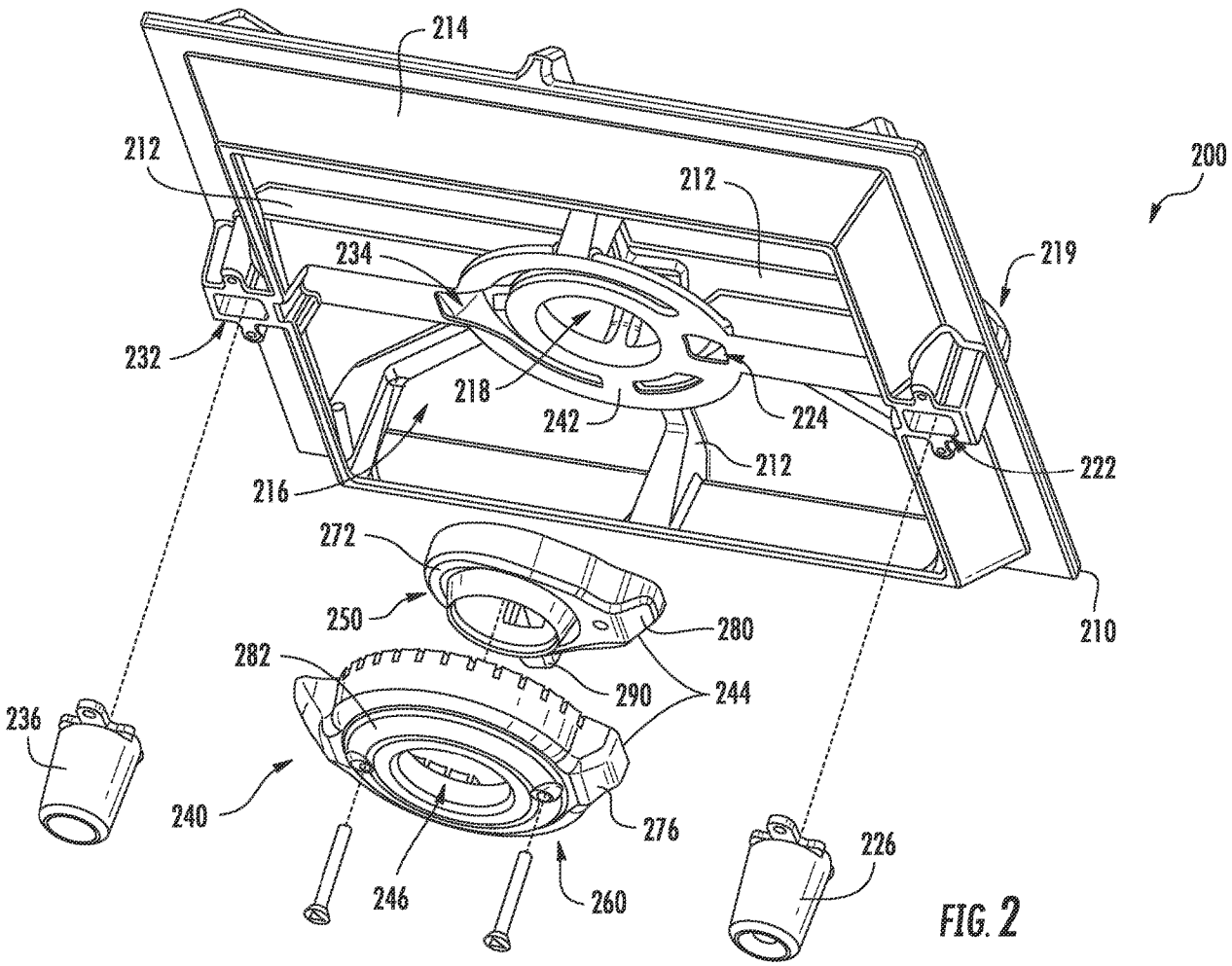
FIG. 2 provides an exploded bottom, perspective view of the gas burner assembly of the exemplary cooktop appliance of FIG. 1.

As may be seen in FIG. 1, gas burner assembly 200 is removable from panel 102 of cooktop appliance 100. In certain exemplary embodiments, no mechanical fastening connects gas burner assembly 200 to panel 102. Thus, gas burner assembly 200 may not be fastened to panel 102, and a user may simply lift gas burner assembly 200 upwardly to remove gas burner assembly 200 from panel 102, as shown in FIG. 2. In such a manner, top surface 104 of panel 102 below gas burner assembly 200 may be easily accessible and cleanable.

Cooktop appliance 100 also includes fuel lines 122. Fuel lines 122 extend between control valves and fuel orifices (not shown) below panel 102. When the control valves are open, fuel, such as propane or natural gas, may flow through fuel lines 122 to the fuel orifices. From the fuel orifices, the fuel may flow into gas burner assemblies 200 where the fuel may be combusted, as discussed in greater detail below.

Between the fuel orifices and gas burner assemblies 200, fuel from the fuel orifices may entrain and mix with air. Cooktop appliance 100 includes features for assisting mixing of air and fuel as the fuel enters gas burner assemblies 200. In particular, cooktop appliance 100 includes Venturi mixers 126 that receive the fuel and air and facilitate fluid mixing of the fuel and air. For example, Venturi mixers 126 may be tapered such that a pressure of the fuel and air decreases while a velocity of the fuel and air increases. Downstream of Venturi mixers 126, the pressure of the fuel and air may increase while the velocity of the fuel and air decreases to further assist fluid mixing between the fuel and air entering gas burner assemblies 200.

Figure 3:
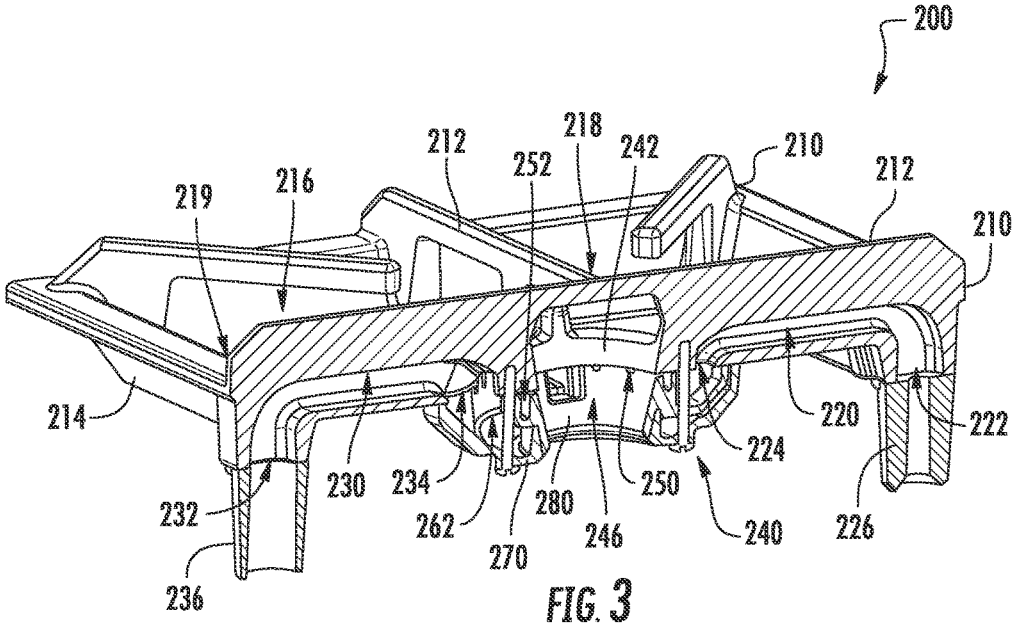
FIG. 3 provides a section view of the gas burner assembly of the exemplary cooktop appliance of FIG. 1.
Figure 4:
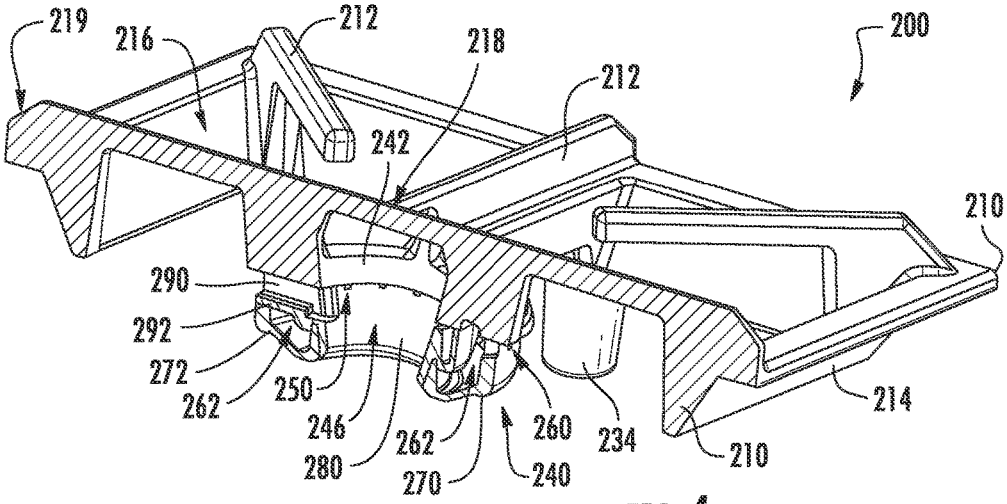
FIG. 4 provides another section view of the gas burner assembly of the exemplary cooktop appliance of FIG. 1.

FIG. 2 provides an exploded bottom, perspective view of gas burner assembly 200. FIG. 3 provides a section view of gas burner assembly 200. FIG. 4 provides another section view of gas burner assembly 200. Various features of gas burner assembly 200 are discussed in greater detail below in the context of FIGS. 2-4.

As may be seen in FIGS. 2-4, gas burner assembly 200 includes a grate 210 and a burner 240. Grate 210 is configured for supporting a cooking utensil, such as a pot, pan, etc. For example, grate 210 includes a plurality of elongated members 212, e.g., formed of cast metal, such as cast iron. The cooking utensil may be placed on the elongated members 212 of grate 210 such that the cooking utensil rests on an upper surface of elongated members 212. Elongated members 212 of grate 210 may include an outer frame 214 that extends around or defines a perimeter of grate 210 and/or gas burner assembly 200. Thus, outer frame 214 may be positioned at an outer portion 219 of grate 210. Grate 210 may rest on panel 102 at outer frame 214 of grate 200. Thus, a bottom surface of outer frame 214 may rest on top surface 104 of panel 102. As shown in FIG. 2, outer frame 214 of grate 210 may be square or rectangular in certain exemplary embodiments. Within outer frame 214, elongated members 212 may define an inner passage 216 that extends through grate 210. Thus, fluid, such as air, may flow through grate 210 via inner passage 216.

Burner 240 may be positioned at a central portion 218 of grate 210. Thus, burner 240 may be positioned at or within inner passage 216 of grate 210, e.g., such that air within inner passage 216 of grate 210 flows by or around burner 240. Burner 240 may include a cap 242 and bases 244. Cap 242 of burner 240 may be mounted to grate 210. In particular, cap 242 may be integrally formed with grate 210, e.g., such that grate 210 and cap 242 of burner 240 are formed of or with a common piece of material. For example, grate 210 and cap 242 of burner 240 may be cast as a single, continuous piece of metal, such as cast iron. Bases 244 of burner 240 are mounted to cap 242 of burner 240, e.g., with fasteners, such that base 244 and cap 242 of burner 240 form flame ports of burner 240, as discussed in greater detail below. Thus, cap 242 of burner 240 and bases 244 of burner 240 may be separate pieces of material, such as cast metal, that are mounted to each other to form burner 240.

Figure 5:
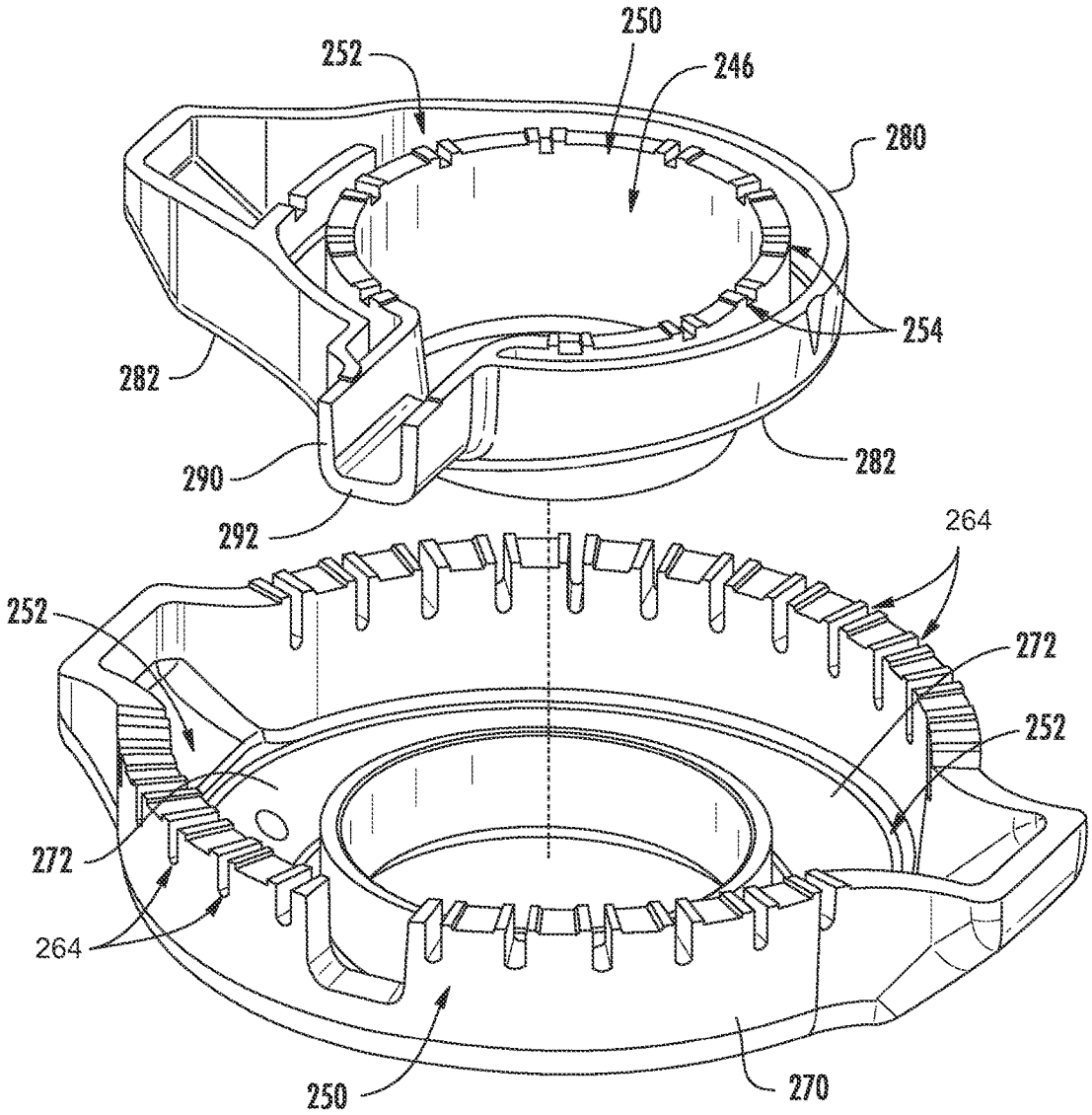
FIG. 5 provides an exploded view of a burner of the gas burner assembly of FIG. 2.
Figure 6:
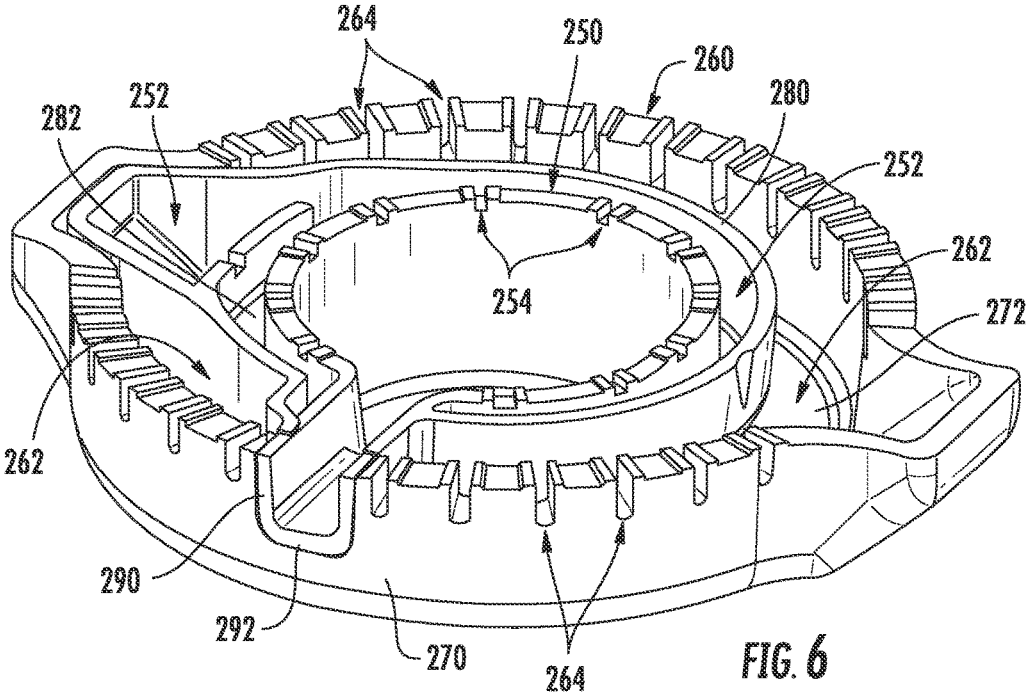
FIG. 6 provides a perspective view of the burner of FIG. 5.
Figure 7:
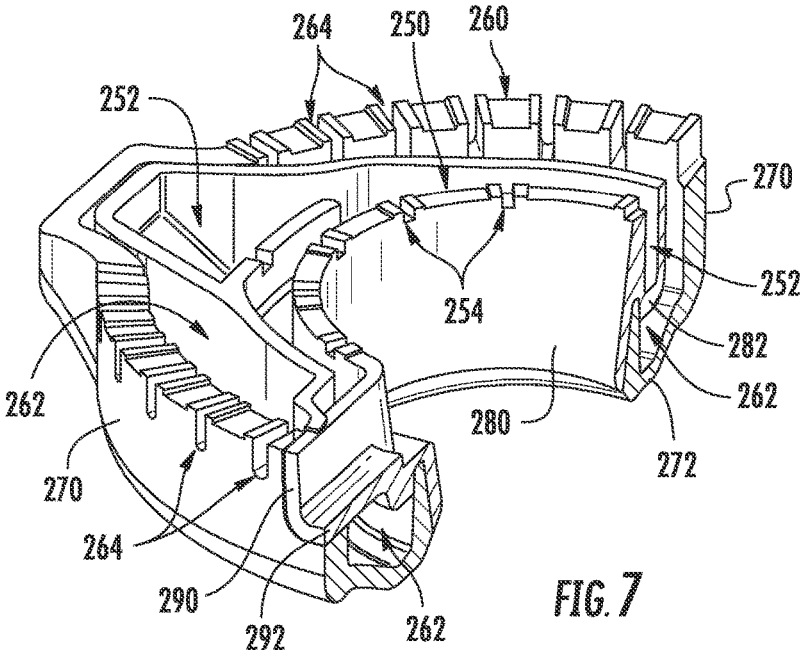
FIG. 7 provides a section view of the burner of FIG. 6.

FIG. 5 provides an exploded view of bases 244 of burner 240. FIG. 6 provides a perspective view of bases 244 of burner 240. FIG. 7 provides a section view of bases 244 of burner 240. As shown in FIGS. 5-7, burner 240 is a multi-ring burner. Thus, burner 240 includes an inner burner ring 250 and an outer burner ring 260. The inner and outer burner rings 250, 260 may be concentrically positioned, e.g., such that outer burner ring 260 extends around inner burner ring 250. Inner burner ring 250 has a fuel chamber 252 and a plurality of flame ports 254. Similarly, outer burner ring 260 has a fuel chamber 262 and a plurality of flame ports 264. As shown in FIG. 4, cap 242 of burner 240 may define a passage 246 that allows air to flow through burner 240 at inner burner ring 250. Fuel chamber 252 of inner burner ring 250 and/or fuel chamber 262 of outer burner ring 260 may extend circumferentially around passage 246 within burner 240.

Turning back to FIG. 3, grate 210 includes features for supplying fuel to burner 240, e.g., to inner burner ring 250 and outer burner ring 260 of burner 240. In particular, grate 210 defines a first internal fuel passage 220 and a second internal fuel passage 230. First and second internal fuel passages 220, 230 are configured for directing fuel through grate 210 to burner 240. In particular, first internal fuel passage 220 is contiguous with fuel chamber 252 of inner burner ring 250. Thus, fuel from first internal fuel passage 220 may flow into fuel chamber 252 of inner burner ring 250 and exit fuel chamber 252 of inner burner ring 250 at flame ports 254 of inner burner ring 250 where such fuel may be combusted. Similarly, second internal fuel passage 230 is contiguous with fuel chamber 262 of outer burner ring 260. Thus, fuel from second internal fuel passage 230 may flow into fuel chamber 262 of outer burner ring 260 and exit fuel chamber 262 of outer burner ring 260 at flame ports 264 of outer burner ring 260 where such fuel may be combusted.

By mounting burner 240 to grate 210 and directing fuel through grate 210 to burner 240, cleaning panel 102 below gas burner assembly 200 may be facilitated. For example, as shown in FIG. 3, burner 240 may be mounted to grate 210 such that burner 240 is suspended above or spaced apart from top surface 104 of panel 102 by a gap, e.g., of at least one inch. With burner 240 separated from top surface 104 of panel 102, heat transfer between burner 240 and panel 102 may be limited. Thus, panel 102 may be cooler during operation of gas burner assembly 200 relative to burners that contact panel 102, and burning of spilled or overflowed food particles on top surface 104 of panel 102 may be reduced or limited. In addition, with burner 240 separated from top surface 104 of panel 102, access to panel 102 below burner 240 may be easier than compared to burners that are positioned on and mounted to panel 102, and a user may more easily reach below burner 240 to clean spills and overflows below burner 240. Further, by supplying fuel through grate 210, burner 240 need not receive fuel from directly below burner 240 through panel 102. Thus, panel 102 may have no holes, less holes and/or smaller holes directly below burner 240 relative to burners that are positioned on and mounted to panel 102 and receive fuel from directly below the burners. As shown in FIG. 1, an igniter 130 may be mounted to panel 102 below burner 240, in certain exemplary embodiments.

As may be seen in FIGS. 3 and 4, at least a portion of first and second internal fuel passages 220, 230 may be positioned above flame ports of burner 240. In particular, at least a portion of first internal fuel passage 220 may be positioned above flame ports 254 of inner burner ring 250, and at least a portion of second internal fuel passage 230 may be positioned above flame ports 264 of outer burner ring 260. In such a manner, a vertical space occupied by gas burner assembly 200 may be reduced, and gas burner assembly 200 may have a compact vertical profile. In particular, utilizing first and second internal fuel passages 220, 230 to supply fuel to burner 240 assists with reducing a vertical height of gas burner assembly 200 relative to burners that deliver fuel to burners from directly below or the sides of the burners due to the required spacing between the burners and a cooking utensil needed for proper combustion of fuel. In such a manner, cooktop appliance 100 may have a sleek, low profile that is preferred by certain consumers by delivering fuel to burner 240 through grate 210. As an example, a total vertical height of gas burner assembly 200 may be no greater than three inches in certain exemplary embodiments.

First internal fuel passage 220 extends between an inlet 222 and an outlet 224. Inlet 222 of first internal fuel passage 220 is positioned at or adjacent outer portion 219 of grate 210. Conversely, outlet 224 of first internal fuel passage 220 is positioned at or adjacent central portion 218 of grate 210. Thus, first internal fuel passage 220 may extend between outer portion 219 and central portion 218 of grate 210 within one of the elongated members 212 of grate 210. First Venturi mixer 226 is positioned at inlet 222 of first internal fuel passage 220. First Venturi mixer 226 may also be positioned above one of the fuel orifices below panel 102. Thus, fuel from one of the fuel orifices below panel 102 may pass through first Venturi mixer 226 and enter first internal fuel passage 220 at inlet 222 of first internal fuel passage 220. Outlet 224 of first internal fuel passage 220 is contiguous with fuel chamber 252 of inner burner ring 250. Thus, fuel from first internal fuel passage 220 may flow into burner 240 via outlet 224 of first internal fuel passage 220.

Second internal fuel passage 230 also extends between an inlet 232 and an outlet 234. Inlet 232 of second internal fuel passage 230 is positioned at or adjacent outer portion 219 of grate 210. Conversely, outlet 234 of second internal fuel passage 230 is positioned at or adjacent central portion 218 of grate 210. Thus, second internal fuel passage 230 may extend between outer portion 219 and central portion 218 of grate 210 within one of the elongated members 212 of grate 210. Second Venturi mixer 236 is positioned at inlet 232 of second internal fuel passage 230. Second Venturi mixer 236 may also be positioned above one of the fuel orifices below panel 102. Thus, fuel from one of fuel orifices below panel 102 may pass through second Venturi mixer 236 and enter second internal fuel passage 230 at inlet 232 of second internal fuel passage 230. Outlet 234 of second internal fuel passage 230 is contiguous with fuel chamber 262 of outer burner ring 260. Thus, fuel from second internal fuel passage 230 may flow into burner 240 via outlet 234 of second internal fuel passage 230.

As shown in FIG. 3, first and second Venturi mixers 226, 236 may be positioned opposite each other on gas burner assembly 200. In particular, burner 240 may be positioned between first and second Venturi mixers 226, 236. Thus, first and second internal fuel passages 220, 230 may also be positioned opposite each other on gas burner assembly 200, and burner 240 may be positioned between first and second internal fuel passages 220, 230. In particular, outlet 224 of first internal fuel passage 220 may be positioned opposite outlet 234 of second internal fuel passage 230 on burner 240.

Grate 210 may be constructed of or with any suitable material. For example, grate 210 may be constructed of or with a single piece of cast metal. In particular, grate 210 may be formed of cast iron with first and second internal fuel passages 220, 230 formed within grate 210 by using disposable cores during the casting process. First and second Venturi mixers 226, 236 may also be integrally formed with grate 210 or may be separate components mounted, e.g., fastened, to grate 210.

Turning back to FIGS. 5-7, burner 240 includes an outer base 270 and an inner base 280. Outer base 270 of burner 240 may be mounted to cap 242 (FIG. 2) of burner 240, e.g., such that cap 242 and outer base 270 of burner 240 define flame ports 264 of outer burner ring 260. As shown in FIG. 6, inner base 280 of burner 240 may be nested or disposed within outer base 270 of burner 240. In particular, inner base 280 of burner 240 may be nested or disposed within outer base 270 of burner 240 such that cap 242 and inner base 280 of burner 240 define flame ports 254 of inner burner ring 250, e.g., when outer base 270 of burner 240 is mounted to cap 242.

Outer base 270 and inner base 280 of burner 240 may also define fuel chamber 252 of inner burner ring 250 and fuel chamber 262 of outer burner ring 260. Thus, e.g., a side wall of inner base 280 may be disposed between fuel chamber 252 of inner burner ring 250 and fuel chamber 262 of outer burner ring 260 in order to separate fuel chamber 252 of inner burner ring 250 from fuel chamber 262 of outer burner ring 260 within burner 240, as shown in FIG. 6.

Turning back to FIGS. 3 and 4, burner 240 also includes features for distributing fuel flow into burner 240. In particular, at least a portion of fuel chamber 262 of outer burner ring 260 may be positioned directly below fuel chamber 252 of inner burner ring 250. Thus, a bottom wall of inner burner ring 250 (e.g., a bottom wall 282 of inner base 280) and a bottom wall of outer burner ring 260 (e.g., a bottom wall 272 of outer base 270) may be spaced apart from each other at or within fuel chamber 262 of outer burner ring 260, e.g., by no less than a quarter of an inch. In such a manner, fuel chamber 262 of outer burner ring 260 may be disposed between the bottom wall of inner burner ring 250 and the bottom wall of outer burner ring 260 such that fuel within fuel chamber 262 of outer burner ring 260 may flow between the bottom wall of inner burner ring 250 and the bottom wall of outer burner ring 260. Such positioning of fuel chamber 252 of inner burner ring 250 and fuel chamber 262 of outer burner ring 260 may assist with decreasing a velocity gradient of fuel entering fuel chamber 262 of outer burner ring 260 at outlet 234 of second internal fuel passage 230 by increasing a volume of fuel chamber 262 of outer burner ring 260 relative to other burners, e.g., without having to increase a radial size of outer burner ring 260 or reduce a radial size of inner burner ring 250. Thus, fuel chamber 262 of outer burner ring 260 may be positioned directly below fuel chamber 252 of inner burner ring 250 proximate outlet 234 of second internal fuel passage 230 such that fuel from second internal fuel passage 230 of grate 210 flowing into fuel chamber 262 of outer burner ring 260 from outlet 234 of second internal fuel passage 230 flows beneath fuel chamber 252 of inner burner ring 250 within fuel chamber 262 of outer burner ring 260, e.g., in order to provide additional volume for fuel entering fuel chamber 262 of outer burner ring 260.

Turning back to FIGS. 5-7, burner 240 also includes a crossover duct 290. Crossover duct 290 extends between inner burner ring 250 and outer burner ring 260. Crossover duct 290 is configured for assisting with transferring flames between inner burner ring 250 and outer burner ring 260. Thus, e.g., fuel at flame ports 254 of inner burner ring 250 may be ignited with igniter 130, and flames at flame ports 254 of inner burner ring 250 may ignite fuel within crossover duct 290 that in turn ignites fuel at flame ports 264 of outer burner ring 260. Crossover duct 290 may also include or define flame ports, e.g., at a top portion of crossover duct 290 at cap 242, that are distributed or extend between inner burner ring 250 and outer burner ring 260.

Crossover duct 290 may be positioned such that fuel within fuel chamber 262 of outer burner ring 260 may flow beneath crossover duct 290. Thus, as shown in FIG. 7, a bottom wall 292 of crossover duct 290 may be spaced apart from or suspended over bottom wall 272 of outer burner ring 270, e.g., by no less than a quarter of an inch. By separating bottom wall 292 of crossover duct 290 from bottom wall 272 of outer burner ring 270, fuel within fuel chamber 262 of outer burner ring 260 may flow between bottom wall 292 of crossover duct 290 and bottom wall 272 of outer burner ring 270. In such a manner, fuel distribution to flame ports 264 of outer burner ring 260 within fuel chamber 262 of outer burner ring 260 may be improved or facilitated relative to burners where a crossover duct extends across and divides fuel chamber 262 of outer burner ring 260. As shown in FIGS. 5-7, bottom wall 292 of crossover duct 290 may be integrally formed with inner base 280. Thus, bottom wall 292 of crossover duct 290 and inner base 280 may be formed of or with a common piece of material, such as cast metal.

Bottom wall 282 of inner base 280 may also be positioned such that fuel within fuel chamber 262 of outer burner ring 260 may flow beneath bottom wall 282 of inner base 280. For example, bottom wall 282 of inner base 280 may be spaced apart from or suspended over bottom wall 272 of outer burner ring 270 at or adjacent (e.g., directly below) outlet 224 of first internal fuel passage 220, e.g., by no less than a quarter of an inch. By separating bottom wall 282 of inner base 280 from bottom wall 272 of outer burner ring 270, fuel within fuel chamber 262 of outer burner ring 260 may flow between bottom wall 282 of inner base 280 and bottom wall 272 of outer burner ring 270. In such a manner, fuel distribution to flame ports 264 of outer burner ring 260 within fuel chamber 262 of outer burner ring 260 may be improvised or facilitated relative to burners where inner base 280 extends across and divides fuel chamber 262 of outer burner ring 260.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A gas burner assembly, comprising:

a grate configured for supporting a cooking utensil, the grate defining a first internal fuel passage and a second internal fuel passage; and a burner defining an inner burner ring and an outer burner ring, the inner burner ring and the outer burner ring each defining a plurality of flame ports, the first internal fuel passage of the grate extending to the inner burner ring such that fuel is directed to the inner burner ring via the first internal fuel passage of the grate, the second internal fuel passage of the grate extending to the outer burner ring such that fuel is directed to the outer burner ring via the second internal fuel passage of the grate, wherein the inner burner ring and the outer burner ring each define a fuel chamber, the fuel chamber of the inner burner ring contiguous with the plurality of flame ports of inner burner ring, the fuel chamber of the outer burner ring contiguous with the plurality of flame ports of outer burner ring, at least a portion of the fuel chamber of the outer burner ring positioned directly below the fuel chamber of the inner burner ring, and wherein at least a portion of the first internal fuel passage is positioned above the plurality of flame ports of inner burner ring and at least a portion of the second internal fuel passage is positioned above the plurality of flame ports of outer burner ring.

2. The gas burner assembly of claim 1, wherein the second internal fuel passage of the grate extends between an inlet and an outlet, the outlet of the second internal fuel passage configured for directing fuel from the second internal fuel passage of the grate into the fuel chamber of the outer burner ring, the fuel chamber of the outer burner ring positioned directly below the fuel chamber of the inner burner ring proximate the outlet of the second internal fuel passage such that fuel from the second internal fuel passage of the grate flowing into the fuel chamber of the outer burner ring from the outlet of the second internal fuel passage flows beneath the fuel chamber of the inner burner ring within the fuel chamber of the outer burner ring.

3. The gas burner assembly of claim 1, wherein the burner comprises a crossover duct that extends between the inner burner ring and the outer burner ring, the crossover duct configured for transferring flames between the inner burner ring and the outer burner ring.

4. The gas burner assembly of claim 3, wherein a bottom wall of the crossover duct is spaced apart from a bottom wall of the outer burner ring such that fuel within the fuel chamber of the outer burner ring flows between the bottom wall of the crossover duct and the bottom wall of the outer burner ring.

5. The gas burner assembly of claim 3, wherein the fuel chamber of the outer burner ring extends beneath the crossover duct.

6. The gas burner assembly of claim 3, wherein the burner comprises a cap, an outer base and an inner base, the cap of the burner integrally formed with the grate, the outer base of the burner mounted to the cap such that the cap and the outer base of the burner define the plurality of flame ports of outer burner ring, the inner base of the burner nested within the outer base such that the cap and the inner base of the burner define the plurality of flame ports of inner burner ring.

7. The gas burner assembly of claim 6, wherein a bottom wall of the crossover duct is integrally formed with the inner base.

8. The gas burner assembly of claim 6, wherein a bottom wall of the inner base is spaced apart from a bottom wall of the outer burner ring such that fuel within the fuel chamber of the outer burner ring flows between the bottom wall of the inner base and the bottom wall of the outer burner ring.

9. The gas burner assembly of claim 1, wherein an outlet of the first internal fuel passage is positioned opposite an outlet of the second internal fuel passage on the burner.

10. A gas burner assembly, comprising:

a grate configured for supporting a cooking utensil, the grate defining a first internal fuel passage and a second internal fuel passage; and a burner defining an inner burner ring and an outer burner ring, the inner burner ring and the outer burner ring each defining a plurality of flame ports, the first internal fuel passage of the grate extending to the inner burner ring such that fuel is directed to the inner burner ring via the first internal fuel passage of the grate, the second internal fuel passage of the grate extending to the outer burner ring such that fuel is directed to the outer burner ring via the second internal fuel passage of the grate, wherein the inner burner ring and the outer burner ring each define a fuel chamber, the fuel chamber of the inner burner ring contiguous with the plurality of flame ports of inner burner ring, the fuel chamber of the outer burner ring contiguous with the plurality of flame ports of outer burner ring, a bottom wall of the inner burner ring and a bottom wall of the outer burner ring spaced apart from each other at the fuel chamber of the outer burner ring such that the fuel chamber of the outer burner ring is disposed between the bottom wall of the inner burner ring and the bottom wall of the outer burner ring, and wherein the second internal fuel passage of the grate extends between an inlet and an outlet, the outlet of the second internal fuel passage configured for directing fuel from the second internal fuel passage of the grate into the fuel chamber of the outer burner ring, the fuel chamber of the outer burner ring is disposed between the bottom wall of the inner burner ring and the bottom wall of the outer burner ring proximate the outlet of the second internal fuel passage such that fuel from the second internal fuel passage of the grate flowing into the fuel chamber of the outer burner ring from the outlet of the second internal fuel passage flows between the bottom wall of the inner burner ring and the bottom wall of the outer burner ring within the fuel chamber of the outer burner ring.

11. The gas burner assembly of claim 10, wherein at least a portion of the first internal fuel passage is positioned above the plurality of flame ports of inner burner ring and at least a portion of the second internal fuel passage is positioned above the plurality of flame ports of outer burner ring.

12. The gas burner assembly of claim 10, wherein the burner comprises a crossover duct that extends between the inner burner ring and the outer burner ring, the crossover duct configured for transferring flames between the inner burner ring and the outer burner ring.

13. The gas burner assembly of claim 12, wherein a bottom wall of the crossover duct is spaced apart from the bottom wall of the outer burner ring such that fuel within the fuel chamber of the outer burner ring flows between the bottom wall of the crossover duct and the bottom wall of the outer burner ring.

14. The gas burner assembly of claim 12, wherein the fuel chamber of the outer burner ring extends beneath the crossover duct.

15. The gas burner assembly of claim 12, wherein the burner comprises a cap, an outer base and an inner base, the cap of the burner integrally formed with the grate, the outer base of the burner mounted to the cap such that the cap and the outer base of the burner define the plurality of flame ports of outer burner ring, the inner base of the burner nested within the outer base such that the cap and the inner base of the burner define the plurality of flame ports of inner burner ring.

16. The gas burner assembly of claim 15, wherein a bottom wall of the crossover duct is integrally formed with the inner base.

17. The gas burner assembly of claim 15, wherein a bottom wall of the inner base is spaced apart from a bottom wall of the outer burner ring such that fuel within the fuel chamber of the outer burner ring flows between the bottom wall of the inner base and the bottom wall of the outer burner ring.

18. The gas burner assembly of claim 10, wherein an outlet of the first internal fuel passage is positioned opposite an outlet of the second internal fuel passage on the burner.

19. A gas burner assembly, comprising:

a grate configured for supporting a cooking utensil, the grate defining a first internal fuel passage and a second internal fuel passage; and a burner defining an inner burner ring and an outer burner ring, the inner burner ring and the outer burner ring each defining a plurality of flame ports, the first internal fuel passage of the grate extending to the inner burner ring such that fuel is directed to the inner burner ring via the first internal fuel passage of the grate, the second internal fuel passage of the grate extending to the outer burner ring such that fuel is directed to the outer burner ring via the second internal fuel passage of the grate, wherein the inner burner ring and the outer burner ring each define a fuel chamber, the fuel chamber of the inner burner ring contiguous with the plurality of flame ports of inner burner ring, the fuel chamber of the outer burner ring contiguous with the plurality of flame ports of outer burner ring, at least a portion of the fuel chamber of the outer burner ring positioned directly below the fuel chamber of the inner burner ring, and wherein the burner comprises a crossover duct that extends between the inner burner ring and the outer burner ring, the crossover duct configured for transferring flames between the inner burner ring and the outer burner ring.

* * * * *